US009066580B2

(12) United States Patent
Marichi Rodriguez

(10) Patent No.: US 9,066,580 B2
(45) Date of Patent: Jun. 30, 2015

(54) TOOTHBRUSH HAVING BENT BRISTLES

(71) Applicant: Francisco Javier Marichi Rodriguez, Distrito Federal (MX)

(72) Inventor: Francisco Javier Marichi Rodriguez, Distrito Federal (MX)

( * ) Notice: Subject to any disclaimer, the term of this patent is extended or adjusted under 35 U.S.C. 154(b) by 0 days.

(21) Appl. No.: 14/352,414

(22) PCT Filed: Oct. 12, 2012

(86) PCT No.: PCT/MX2012/000099
§ 371 (c)(1),
(2) Date: Apr. 17, 2014

(87) PCT Pub. No.: WO2013/058641
PCT Pub. Date: Apr. 25, 2013

(65) Prior Publication Data

US 2014/0345073 A1 Nov. 27, 2014

(30) Foreign Application Priority Data

Oct. 19, 2011 (MX) ..... MX/a/2011/011017

(51) Int. Cl.
*A46B 9/04* (2006.01)
*A46B 9/02* (2006.01)

(52) U.S. Cl.
CPC . *A46B 9/04* (2013.01); *A46B 9/045* (2013.01); *A46B 9/026* (2013.01)

(58) Field of Classification Search
CPC ... A46B 9/04; A46B 9/045; A46B 2200/1066
USPC ..... 15/167.1, 167.2, 22.1, 106, DIG. 5
See application file for complete search history.

(56) References Cited

U.S. PATENT DOCUMENTS

| | | | | |
|---|---|---|---|---|
| 3,100,309 | A | 8/1963 | Gambino | |
| 4,493,125 | A * | 1/1985 | Collis | 15/167.2 |
| 4,706,322 | A * | 11/1987 | Nicolas | 15/106 |
| 5,027,463 | A | 7/1991 | Daub | |
| 5,230,118 | A * | 7/1993 | Chamma | 15/167.2 |

(Continued)

FOREIGN PATENT DOCUMENTS

EP 0118852 A2 9/1984

OTHER PUBLICATIONS

International Search Report, Apr. 18, 2013, from International Phase of the instant application.

(Continued)

*Primary Examiner* — Shay Karls
(74) *Attorney, Agent, or Firm* — Jackson Patent Law Office

(57) ABSTRACT

The present invention provides a toothbrush comprising tufts, bundles, skeins or groups of bent or angled bristles, which may be interspersed with tufts, bundles, skeins or groups of conventional straight bristles in different arrangements in a base area of the head of a toothbrush, which makes the brushing planes or bristle surfaces can be modified, presenting more than one brushing plane or bristle surface, that is, the present invention has bristles bent or angled at their ends, providing other bristle surfaces that allow the brushing of surfaces perpendicular to the bristle insertion plane in the base area of the toothbrush head. This invention allows the brushing of teeth, gums and mucous membranes simultaneously to the brushing of orthodontic appliances, prostheses or implants.

11 Claims, 5 Drawing Sheets

(56) References Cited

U.S. PATENT DOCUMENTS

| | | | | |
|---|---|---|---|---|
| 5,325,560 | A | 7/1994 | Pavone et al. | |
| 5,537,708 | A * | 7/1996 | Luposello | 15/167.2 |
| 5,873,140 | A | 2/1999 | Holloway | |
| 6,260,227 | B1 * | 7/2001 | Fulop et al. | 15/167.1 |
| 7,698,772 | B1 * | 4/2010 | Hauser, Jr. | 15/167.2 |
| 2003/0131433 | A1 * | 7/2003 | Pavone | 15/143.1 |
| 2005/0108842 | A1 * | 5/2005 | Shunock | 15/167.1 |
| 2008/0109979 | A1 * | 5/2008 | Jo | 15/167.1 |

OTHER PUBLICATIONS

English Translation of the Written Opinion of the International Search Authority, Apr. 19, 2014, from International Phase of the instant application.

English Translation of International Preliminary Report on Patentability Chapter I, Apr. 22, 2014, from International Phase of the instant application.

* cited by examiner

TOOTHBRUSH HAVING BENT BRISTLES

FIELD OF THE INVENTION

This invention relates in general to the field of oral hygiene, and in particular, to a toothbrush.

BACKGROUND OF THE INVENTION

Toothbrushes usually have several arrays in the presentation of the bristles, which form or define different surface types of brushing planes or "bristle surface," such as: one level, two levels, various levels, curved, inclined, v-shaped inclined, saw-shaped or jagged, wavy.

Within manufacturing methods there are several types, among which are orthodontic toothbrushes wherein tufts, skeins, bundles or groups of bristles are placed cut at their terminal ends so that a V-shaped or saw-shaped brushing plane or bristle surface is established as described in the U.S. Pat. No. 6,260,227.

Another manufacturing method includes tufts or bundles of straight bristles placed or inserted at different angulations with respect to the base area of the toothbrush head, thus providing crisscrossing of the bristles and several levels of bristle surface, as described in the U.S. Pat. No. 4,706,322, AU 335167, PAJ-2010-179071, PAJ-2009-287861.

In the previous designs, although there are several levels of bristle surfaces, only a brushing plane is established, i.e., brushing is only performed in a single vector or direction, with the disadvantage of not being able to easily clean certain oral zones that are more difficult to access, particularly in the presence of orthodontic appliances, implants or prostheses, among others.

In another manufacturing method, orthodontic toothbrushes known as interdental brushes are presented, wherein tufts of bristles linked or braided by means of a wire are set on the base area of the toothbrush head, as described in the U.S. Pat. No. 7,698,772, US 2008/0109979, U.S. Pat. No. 5,537,708. Such design departs completely from the present invention.

In another method of manufacturing, the base area of the toothbrush head for the insertion or placement of the bristle tufts is divided in three areas forming angles with respect to each other, providing three different base areas in the toothbrush head, in which tufts of straight bristles of different lengths are inserted, thereby obtaining three brushing planes or bristle surfaces in order to brush with greater efficiency the orthodontic brackets, as described in patents AU 311417, U.S. Pat. No. 5,230,118, US 2005/0108842, MX 22508.

The potential problem with such designs is that brushing of the gums or mucous membranes and interproximal or interdental areas becomes more complicated, and the toothbrush construction or manufacturing process may be more complex. Such designs depart from this invention.

In other orthodontic toothbrushes, as the one described in the US patent 2003/0131433, the tuft bristles in the central rows present a bend with a slight angulation of about 15° toward the center of the brush, which as reported by the patent, was designed to reduce the pressure required to deflect the bristles and so reduce the pressure exerted on the gums, and in order to exert less pressure on the brackets an to have greater durability.

The patent UKD 2063495, describes a toothbrush with a design similar to the aforementioned patent; near the insertion to the base area, the bristle tufts in the lateral rows are bent with a slight angulation of about 25° toward the central tufts, thus providing an inclination of the brushing plane or bristle surface, while retaining a U-shaped brushing plane, or with a concave curvature. In some other designs of toothbrushes, this angulation given to the bristles in order to provide inclinations to the brushing plane is replaced by the placing of conventional straight bristles with an inclination or angulation with respect to the base area of bristle insertion.

The designs covered by the patents US 2003/0131433 and UKD 2063495 are the ones more closely approaching to the present invention, as they have tufts of straight bristles alternating with tufts of bent bristles, one toothbrush in its rows of central tufts, and the other one in its rows of lateral tufts. However, these patents depart from this invention since they preserve a single surface of the brushing plane or bristle surface, that is, an additional brushing plane or bristle surface is not established as in the present invention, that additional plane being relevant for the proper cleaning of the oral cavity in the presence of orthodontic appliances, implants or prostheses.

SUMMARY OF THE INVENTION

The present invention provides a toothbrush comprising tufts, skeins, bundles or groups of bent bristles, which may be alternated with tufts, skeins, bundles or groups of conventional straight bristles in different arrangements on a base area of the toothbrush head, thus enabling the modification of the brushing planes, presenting more than one brushing plane or bristle surface, i.e., the present invention has bristles bent or angulated at their terminal ends, providing additional bristle surfaces, which allow the brushing of surfaces perpendicular to the bristle insertion plane on the base area of the toothbrush.

Another feature of the toothbrush of the present invention is that the tufts, bundles, skeins or groups of bristles are bent or angled at its terminal end in an approximate range of 25° to 120°, with the purpose of being able to change the brushing plane or the cleaning direction of the bristles. The tufts, bundles, skeins or groups of bent bristles may be oriented or rotated in different directions, and not necessarily toward the center of the toothbrush, which also modifies the brushing planes of the bristles.

In some embodiments of the present invention, the toothbrush includes tufts or groups of conventional straight bristles of smaller size or length. These tufts are located in the central tuft rows of the base area of the toothbrush head wherein the bristles are inserted. The tufts or groups of bent bristles are located in the lateral rows of tufts, wherein there may be tufts of bent bristles alternated with tufts of straight bristles. The bristle length in the lateral rows of tufts, as well as that of the tuft bristles in the near and distant areas of the base area of the toothbrush head, is greater than the bristle length of the tufts in the central rows.

Furthermore, in some of its embodiments the toothbrush might change the arrangement of the tufts, bundles, skeins or groups of bristles, in such a way that by alternating with tufts, bundles, skeins or groups of conventional straight bristles, the design of the brushing planes or bristle surfaces is modified, allowing the availability of different designs of the toothbrush according to the specific use that is planned.

Toothbrushes perform the oral cleaning by removing plaque and food debris from tooth surfaces, gums, tongue an oral mucosae; however, in some cases, as in the presence of orthodontic appliances, certain areas more difficult to access cannot be cleaned easily, which is why some other cleaning accessories must be used, making the oral brushing more difficult, complex and time-consuming.

Among the advantages of the present invention is the ability to perform with greater ease and efficiency the brushing or cleaning of the oral cavity in the presence of orthodontic appliances, implants, prostheses or other attachments.

These and other features and advantages of the toothbrushes according to this invention may be discussed below with respect to various illustrative embodiments of the invention as defined by the claims.

DETAILED DESCRIPTION OF THE INVENTION

In the following detailed description of the illustrative embodiments, reference is made to the accompanying figures that are part of it, and in which are shown, by means of illustration, specific embodiments in which the invention could be put into practice. It is understood that other methods could be used and that structural changes may be made without departing from the scope of the present invention.

Figure 1:
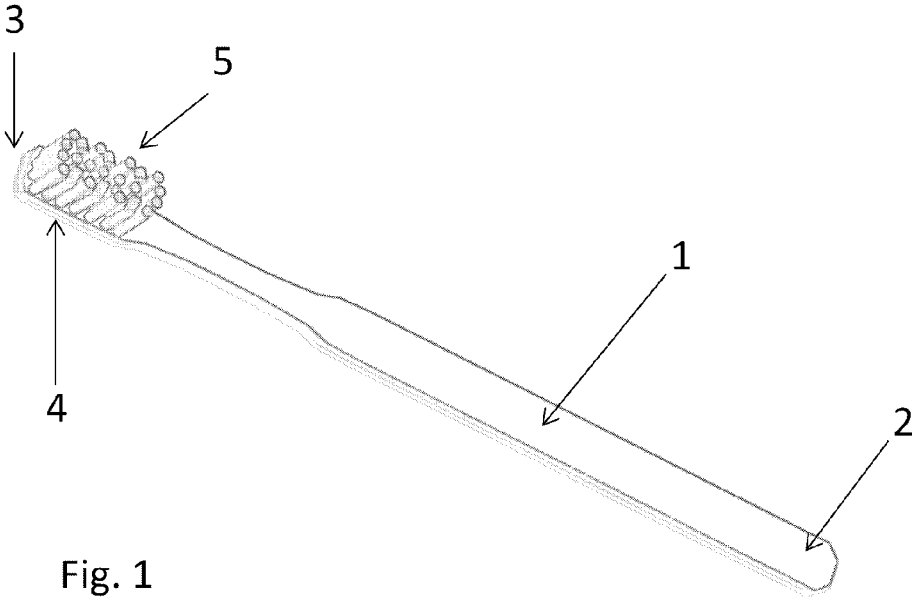
FIG. 1 shows a perspective view of the toothbrush in accordance with the present invention.

FIG. 1 depicts an illustrative embodiment of a toothbrush in accordance with the present invention. The toothbrush includes a handle 1, with a distant end 2 and a near end 3, opposed to the distant end 2. The near end is the base area of the toothbrush head, where tufts of bristles are inserted, also called bundles, skeins or groups of bristles.

The toothbrush could be manufactured of any suitable material known in the art, for example, polymeric materials or copolymers, polypropylene, elastomers, PBT, nylon, metal, wood, fiberglass, etc., and combinations thereof. The toothbrush handle 1 may have any shape, such as rectangular, cylindrical, etc. Preferably the toothbrush handle 1 is shaped to fit the way the user takes it with his/her hand according to the technique, and could be flexible in order to be deformed should the user applied excessive force.

The toothbrush includes a base area of the toothbrush head 4, where the tufts, bundles, skeins or groups of bristles are inserted, using any suitable technique known, for example: adhesives, mechanical fasteners, wires, thermal or chemical welding, pressure, etc. The arrangement of the bristle insertion may take any suitable form, e.g. rectangle, oval, circle, parallelogram, etc. It is preferred that the arrangement of the bristle insertion takes a rectangular shape 5, as illustrated in FIG. 1.

In the base area of the toothbrush head the tufts, bundles, skeins or groups of bristles are inserted, they may have different sizes, shapes and designs of placement as well as different morphological characteristics that modify the surface of the brushing plane or bristle surface, providing additional surfaces of brushing plane.

Figure 2:
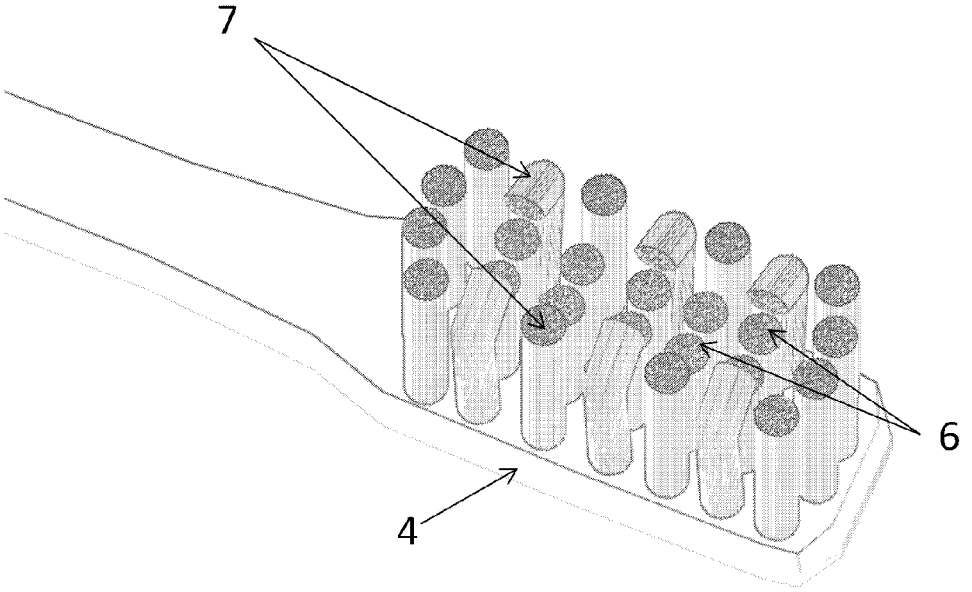
FIG. 2 shows a perspective view of the base area of the toothbrush head and the arrangement of the bristles.

FIG. 2 shows an illustrative embodiment of this invention, where the insertion of tufts, bundles, skeins or groups of bristles has a rectangular shape, making out four longitudinal rows of tufts, of which two are central rows 6, and two are lateral rows 7. The tufts in the two central rows 6, are formed by conventional straight bristles which are shorter in length as compared to the remaining tufts. The lateral rows 7 are formed by two types of tufts, skeins, bundles or groups of bristles, which are alternated with each other.

Figure 3:
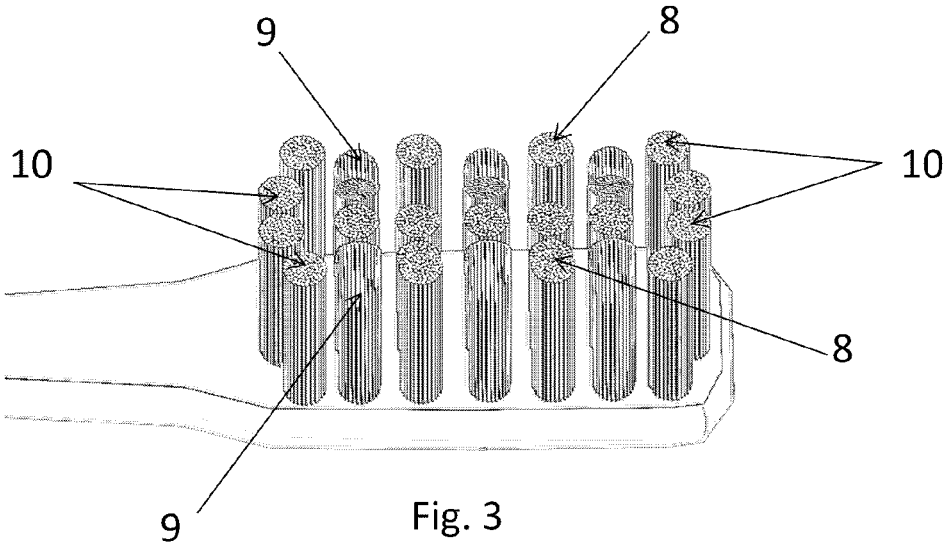
FIG. 3 shows a side view of the base area of the toothbrush head and the arrangement of the bristles.
Figure 4:
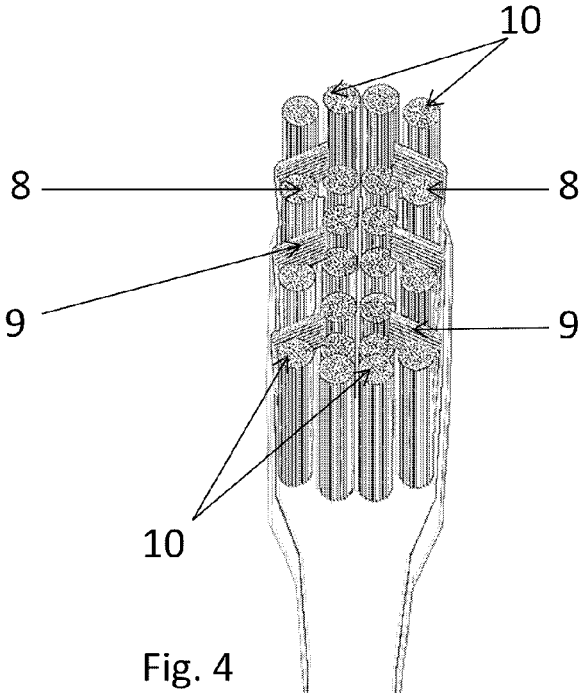
FIG. 4 shows a sectional view of the base area of the toothbrush head and the arrangement of the bristles.
Figure 8:
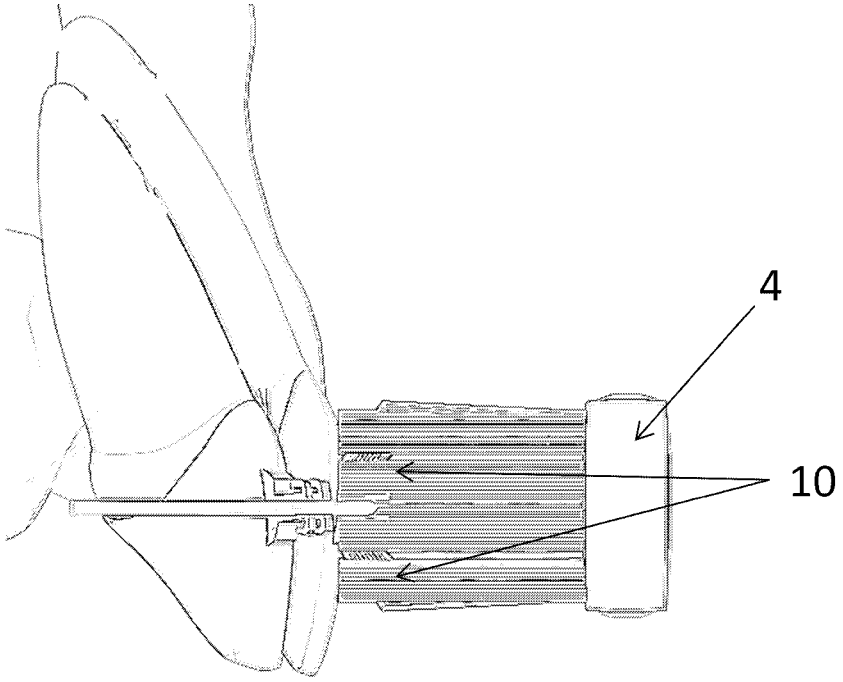
FIG. 8 shows a side view of the base area of the toothbrush head and the bristle arrangement during the brushing of orthodontic appliances.

FIGS. 3 and 4 show an illustrative embodiment of the tufts, skeins, bundles or groups of bristles in the lateral rows. One type of bristle tuft of the lateral rows has conventional straight bristles 8; its height is about 3 mm greater than the height of the tufts located in the central rows. The other type of tufts has bristles bent at its end toward the center of the toothbrush head 9, the bending angle shown by these bristles is about 70°; the height of these tufts is equal to the height of the straight bristle tufts in the side rows; these tufts also have an outward inclination with respect to the base area of bristle insertion of approximately 5°, as seen in FIG. 8.

The tufts on the ends of all rows of tufts, both central and lateral, contain conventional straight bristles with a height equal to that of the straight bristle tufts in the side tuft rows 10.

Figure 5:
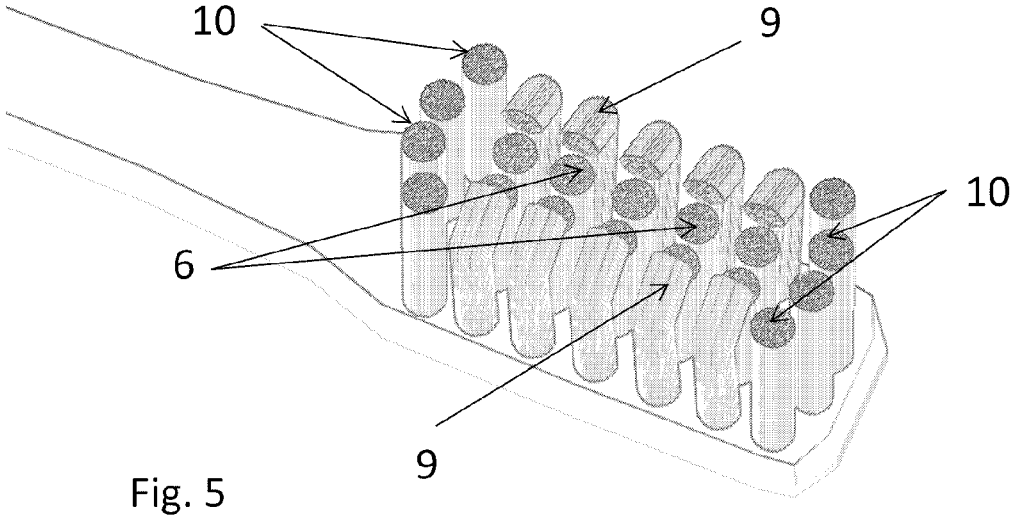
FIG. 5 shows a perspective view of the base area of the toothbrush head with another possible bristle arrangement.
Figure 6:
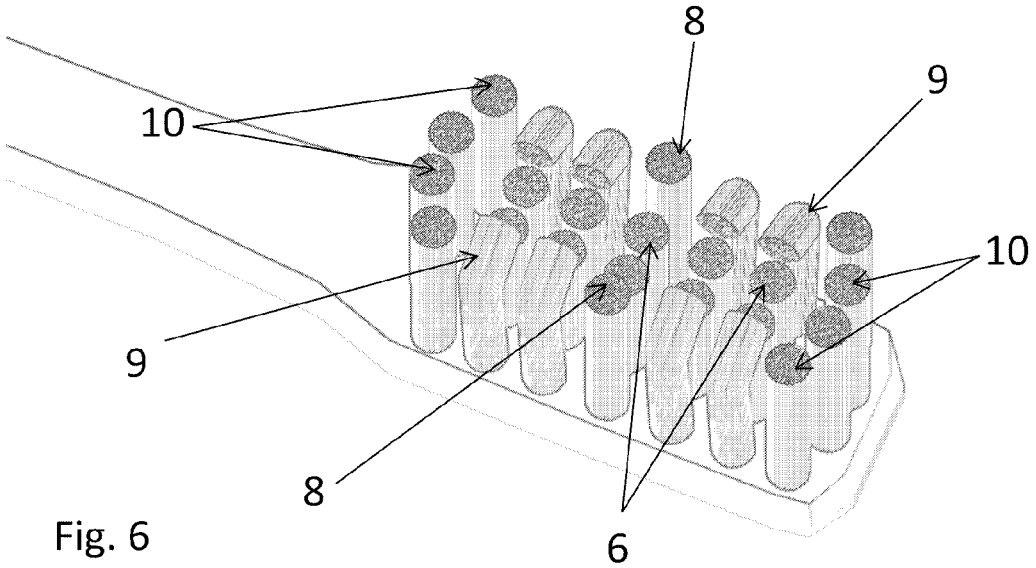
FIG. 6 shows a perspective view of the base area of the toothbrush head with another possible bristle arrangement.

In other embodiments of toothbrushes in accordance with the present invention, as illustrated in FIGS. 5 and 6, the distribution of conventional straight bristle tufts 8, and that of the bent or angled bristle tufts 9, could be modified, making a characterization of several tufts, bundles, skeins or groups of bent bristles located continuously (FIG. 5) or in different designs, modifying or reducing the number of conventional straight bristle tufts in the side rows (FIG. 6), as well as modifying the number and distribution of the short tufts of conventional bristles in the center rows.

It is understood that other embodiments could be used and that changes could be made in the arrangement or placement of the conventional straight bristles and the bent or angled bristles, as well as in the number of tufts, without departing from the scope of the present invention.

The present invention also may be characterized in terms that the bending or angle of the bent or angled bristle tufts may have different directions, not necessarily toward the central rows. That is, the tufts of bent or angled bristles could be oriented in any direction according to the surfaces of brushing plane or bristle surface being sought.

In some embodiments of toothbrushes according to the present invention, the bending or angle shown by the bent bristle tufts may be higher or lower than 70°, considering that the scope of the present invention is to modify the brushing plane or bristle surface by obtaining additional brushing planes that allow brushing or cleaning areas of the oral cavity that have difficult access due to the presence of orthodontic appliances, prosthetic attachments, implants, etc. The incorporation of bent or angled bristles permits the achievement of that purpose.

Figure 7:
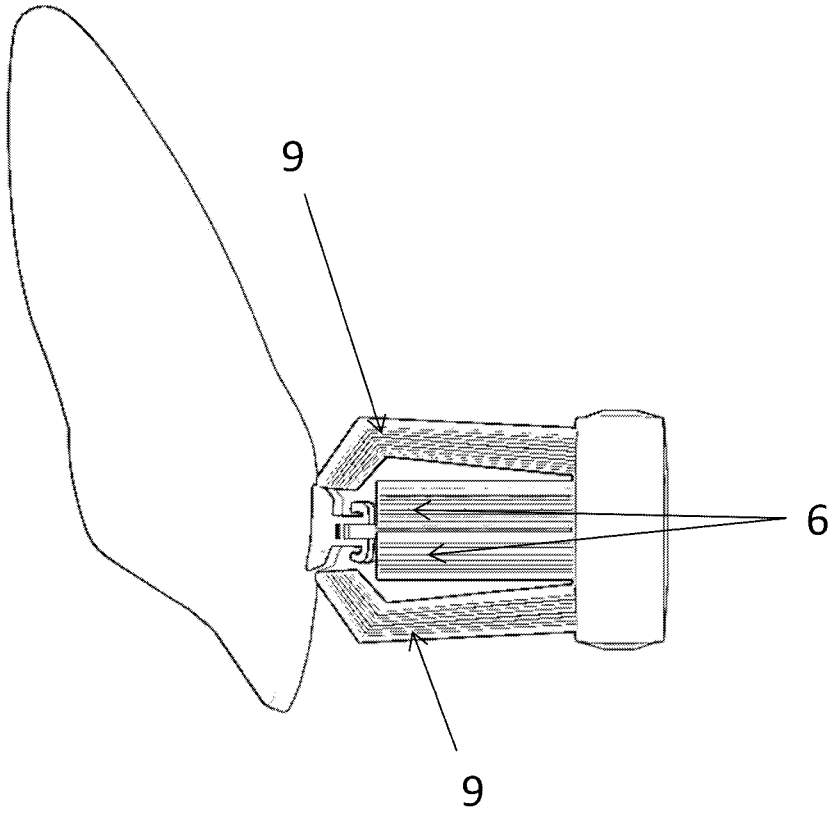
FIG. 7 shows a zooming in of the base area of the toothbrush head in cross section and the arrangement of the bristles during brushing of orthodontic appliances by removing the terminal end of the toothbrush head.

FIG. 7 shows an illustrative embodiment of this invention in a cross section of the base area of the toothbrush head; it is observed how the angle or bending of the bristles provides additional brushing plane surfaces 9, and the presence of the conventional straight short bristle tufts in the center rows 6; the reason for the bristles being shorter is to complement with the bent bristles by offering two brushing plane surfaces complementing each other; in this case it can be seen how both the conventional straight short bristles 6 and the bent or angled bristles 9, brush the buccal surface and wings of the brackets. In this scheme it can also be seen the outward inclination of approximately 5° of the bent bristle tufts 9.

FIG. 8 illustrates the conventional straight bristles in the toothbrush head ends 10, important for cleaning the interdental area.

Figure 9:
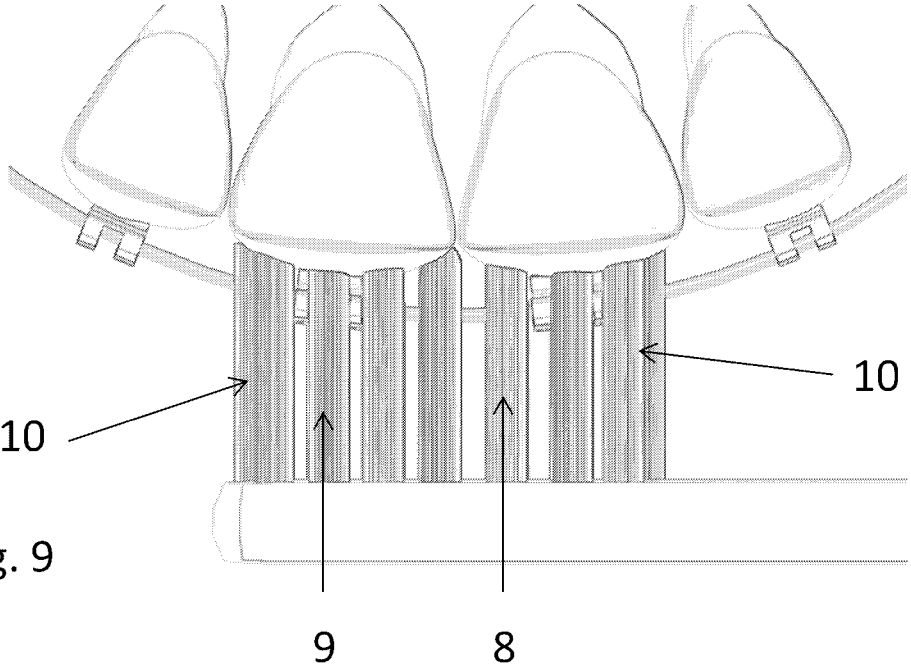
FIG. 9 shows a side or occlusal view of the base area of the toothbrush head and the bristle arrangement during the brushing of orthodontic appliances.
Figure 10:
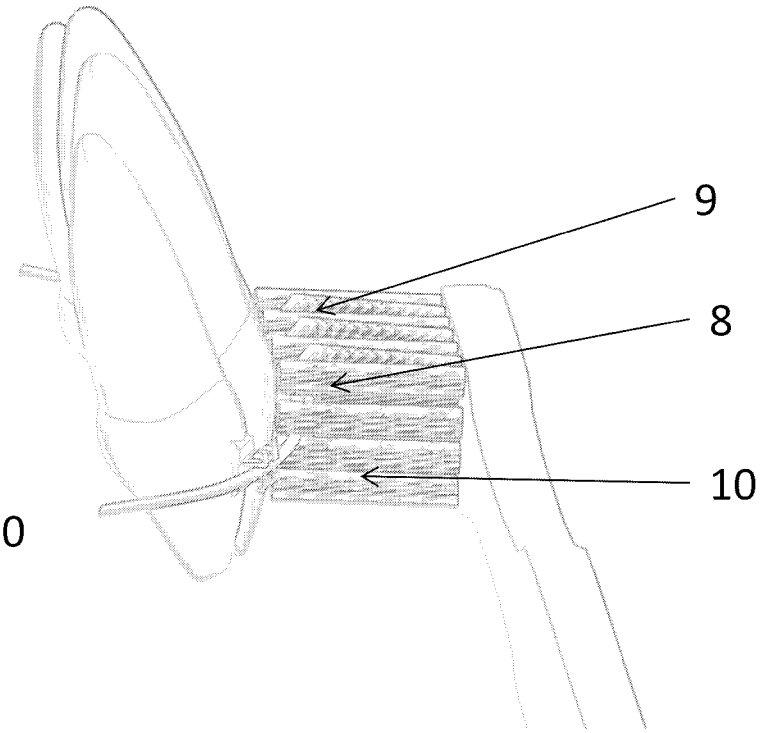
FIG. 10 shows a perspective view of the base area of the toothbrush head during the brushing of teeth and orthodontic appliances.

FIG. 9 shows an occlusal view of the toothbrush head; the tufts of straight bristles and the ones of bent bristles simultaneously brush teeth, gums and brackets, reaching hard to access areas behind the bracket wings. FIG. 10 shows a perspective view of the aforementioned function.

Having sufficiently described the invention in the preceding paragraphs, what is contained in the following claims is claimed as property:

1. A toothbrush comprising: a handle having a far end and a near end; in the near end lies the base surface of the toothbrush head, where a plurality of elongated members are placed, each elongated member including a tuft, a bunch, a skein, or a bristle, the plurality of elongated members forming a particular arrangement or layout; the plurality of elongated members comprise bent elongated members and straight elongated members; in such a way that the bent elongated members allow the brushing in a plane perpendicular to the brushing plane of the straight elongated members; wherein the particular arrangement or layout of elongated members over the toothbrush head comprises a central group of straight elongated members of short height; a perimeter group with higher elongated members equal to each other in terms of height, surrounding the aforesaid central group of elongated members; the perimeter group of elongated members is laid out in such a way that longitudinally on the ends of the toothbrush head there are only straight elongated members, and laterally, between the straight elongated members over the ends of the toothbrush head, there are only bent elongated members.

2. The toothbrush in accordance with claim 1, wherein the perimeter elongated members are higher approximately by 3 mm than the straight elongated members in the central rows.

3. The toothbrush in accordance with claim 1, wherein the elongated members tufts are arranged in longitudinal lateral rows, and a central row.

4. The toothbrush in accordance with claim 1, wherein the bent elongated members are disposed only in the lateral rows.

5. The toothbrush in accordance with claim 1, wherein the bent elongated members display their bending next to their final or terminal end.

6. The toothbrush in accordance with claim 5, wherein the aforesaid bending ranges between 25° and 120°, to obtain brushing planes with different orientations.

7. The toothbrush in accordance with claim 1, wherein the bent elongated members display an outward inclination in relation to the base surface of the toothbrush head.

8. The toothbrush in accordance with claim 7, wherein the outward inclination is approximately 5°.

9. The toothbrush in accordance with claim 1, wherein the arrangement of the elongated members takes the shape of a rectangle, oval or parallelogram.

10. The toothbrush in accordance with claim 1, wherein the bent elongated members are oriented in different directions.

11. The toothbrush in accordance with claim 1, wherein the handle is flexible.

* * * * *